United States Patent [19]

Buchman

[11] Patent Number: 5,057,065

[45] Date of Patent: Oct. 15, 1991

[54] PROCESS FOR MAKING DRAW TAPE BAGS WITH INTEGRALLY FORMED DRAW TAPES

[75] Inventor: James E. Buchman, Appleton, Wis.

[73] Assignee: Reynolds Metals Company, Richmond, Va.

[21] Appl. No.: 448,152

[22] Filed: Dec. 8, 1989

[51] Int. Cl.[5] ..... B31B 23/18; B31B 23/86; B31B 23/90

[52] U.S. Cl. ..... 493/194; 493/211; 493/225; 493/928

[58] Field of Search ..... 493/194, 195, 196, 197, 493/211, 213, 214, 225, 226, 926, 927, 928

[56] References Cited

U.S. PATENT DOCUMENTS

| | | | |
|---|---|---|---|
| 1,861,864 | 6/1932 | Kennedy | 493/225 |
| 1,920,824 | 8/1933 | West | 493/225 |
| 2,777,491 | 1/1957 | Ashton et al. | 493/209 |
| 2,799,611 | 7/1957 | Dreisbach | 493/213 |
| 3,029,853 | 4/1962 | Piazze | 150/11 |
| 3,114,497 | 12/1963 | Kugler | 229/63 |
| 3,196,757 | 7/1965 | Samways | 493/194 |
| 3,283,994 | 11/1966 | Miller | 229/55 |
| 3,371,696 | 3/1968 | Ausnit | 150/3 |
| 3,579,730 | 5/1971 | Ausnit | 18/12 |
| 3,619,395 | 11/1971 | Skendzic | 264/171 |
| 3,738,568 | 6/1973 | Ruda | 229/62 |
| 3,779,139 | 12/1973 | White | 493/194 |
| 3,920,180 | 11/1975 | Meier | 229/63 |
| 4,493,683 | 1/1985 | Jostler | 493/225 |
| 4,558,463 | 12/1985 | Boyd | 493/225 |
| 4,628,536 | 12/1986 | Herrington | 493/211 |
| 4,650,451 | 3/1987 | Herrington | 493/225 |
| 4,664,649 | 5/1987 | Johnson et al. | 493/197 |
| 4,762,430 | 8/1988 | Bullard | 383/75 |
| 4,778,283 | 10/1988 | Osborn | 383/71 |
| 4,786,191 | 11/1988 | Broderick et al. | 383/75 |
| 4,792,241 | 12/1988 | Broderick et al. | 383/75 |
| 4,802,582 | 2/1989 | Johnson | 206/390 |

FOREIGN PATENT DOCUMENTS 2409921 7/1979 France .

*Primary Examiner*—William E. Terrell
*Attorney, Agent, or Firm*—Alan T. McDonald

[57] ABSTRACT

A process for manufacturing draw tape bags, unique tubular films used in the process and the resulting draw tape bags are disclosed. The process begins with the step of forming a tubular film having a longitudinal region with a film strength greater than the film strength of the remainder of the tube. Next, the longitudinal region of greater strength is slit out of the tube and into draw tape ribbons, leaving the remainder of the tube in the form of a continuous sheet with two side edges. A hem with a draw tape access hole is next formed from each of the two side edges, each of the hems encasing a draw tape ribbon. Last, transverse seams are formed in the folded continuous sheet to define individual bag edges and the folded continuous sheets is severed to form individual bags. In one embodiment the longitudinal region of greater strength is made from a resin different than the resin making up the remainder of the tube. In another embodiment the tubular film is formed with the region of greater strength being thicker in its cross-section than the cross-section of the remainder of the film. The resulting bag has a draw tape which is made from film severed from the marginal portion of the bag wall but which has a greater strength than the bag wall film.

23 Claims, 3 Drawing Sheets

PROCESS FOR MAKING DRAW TAPE BAGS WITH INTEGRALLY FORMED DRAW TAPES

BACKGROUND OF THE INVENTION

This invention relates to draw tape bags made from thermoplastic materials. More particularly it relates to processes for making such bags and the bags produced thereby wherein the drawtape material is formed integrally with the material of the bag body.

Draw tape and draw string bags are well known. For example, U.S. Pat. Nos. 1,861,864, 1,920,824, 2,777,491 and 2,799,611 disclose a variety of draw string bags and manufacturing methods. Draw string bags made of thermoplastic materials have also been known. See U.S. Pat. Nos. 3,029,853, 3,114,497 and 3,283,994.

In producing draw tape bags of thermoplastic material, it has been customary to form the draw tape material independent of the bag wall material, and later insert the draw tape into a hem as the hem was formed. See U.S. Pat. Nos. 4,493,683, 4,786,191 and 4,792,241. One improvement in the bag formation process is to make the draw tape at the same time as the bag wall material, and thus eliminate the need for draw tape storage rolls, etc. U.S. Pat. No. 3,196,757 to Samways (incorporated herein by reference) discloses an embodiment in which a tubular film is formed, pleated and slit such that ribbons of web material slit from the bag mouth forming margins are used to form the draw tapes for the bag, and are channeled into hems in the usual manner.

The present invention provides a further improvement to such a integral draw tape and bag forming process. Since the draw tape disclosed in the process of U.S. Pat. No. 3,196,757 is made of the same material as the bag wall, the strength of the draw tape and strength of the bag wall are necessarily related. If a stronger draw tape is desired, the bag wall thickness could be increased, or the entire bag structure could be formed from a resin having greater strength properties. The costs associated with either solution, however, may not be justified, since a suitable strong bag may be formed of the thinner or lower cost material.

Thus, a simple manufacturing process which produces a thermoplastic draw tape bag in which the draw tape strength properties are independent of the strength of the rest of the bag, yet still allowing integral formation of the draw tape and the bag material, is a significant invention.

SUMMARY OF THE INVENTION

The present invention provides a process for manufacturing draw tape bags including the steps of forming a tubular film having a longitudinal region with a film strength greater than the film strength of the remainder of the tube; slitting the longitudinal region of greater strength out of the tube and into draw tape ribbons, leaving the remainder of the tube in the form of a continuous sheet with two side edges; forming a hem with a draw tape access hole from each of the two side edges, each of said hems encasing a draw tape ribbon; forming transverse seams in the continuous sheet to define individual bag edges and severing the folded continuous sheet to form individual bags.

There are two preferred methods of forming the longitudinal region of greater strength: 1) making the cross-section of the tube thicker in the longitudinal region of greater strength and 2) making the longitudinal region of greater strength out of a resin having greater strength properties than the film of the resin out of which the remainder of the tube is formed. Of course both methods can be combined and thus practiced simultaneously. The first method is practiced by increasing the size of the gap formed by the die lips in one area of the circumference of a blown film die. The second method is practiced by introducing two resins into different parts of a blown film die.

By making the section of the tube destined to become the draw tape out of a material of greater strength, the improved strength of the draw tape is independent of the bag wall material. Thus a draw tape bag can be made with strong draw tapes and with less expensive bag wall material. At the same time, the draw tape material is integrally formed with the bag wall material. This benefit avoids the trouble of forming the draw tape material independently, storing it and feeding it back into a bag making operation. Also, since the entire operation is continuous, production costs are minimized.

These and other advantages of the invention, as well as the invention itself, will best be understood in view of the accompanying detailed description of the preferred embodiments and accompanying drawings, which are briefly described as follows:

DETAILED DESCRIPTION OF THE PREFERRED EMBODIMENTS OF THE INVENTION

Figure 1:
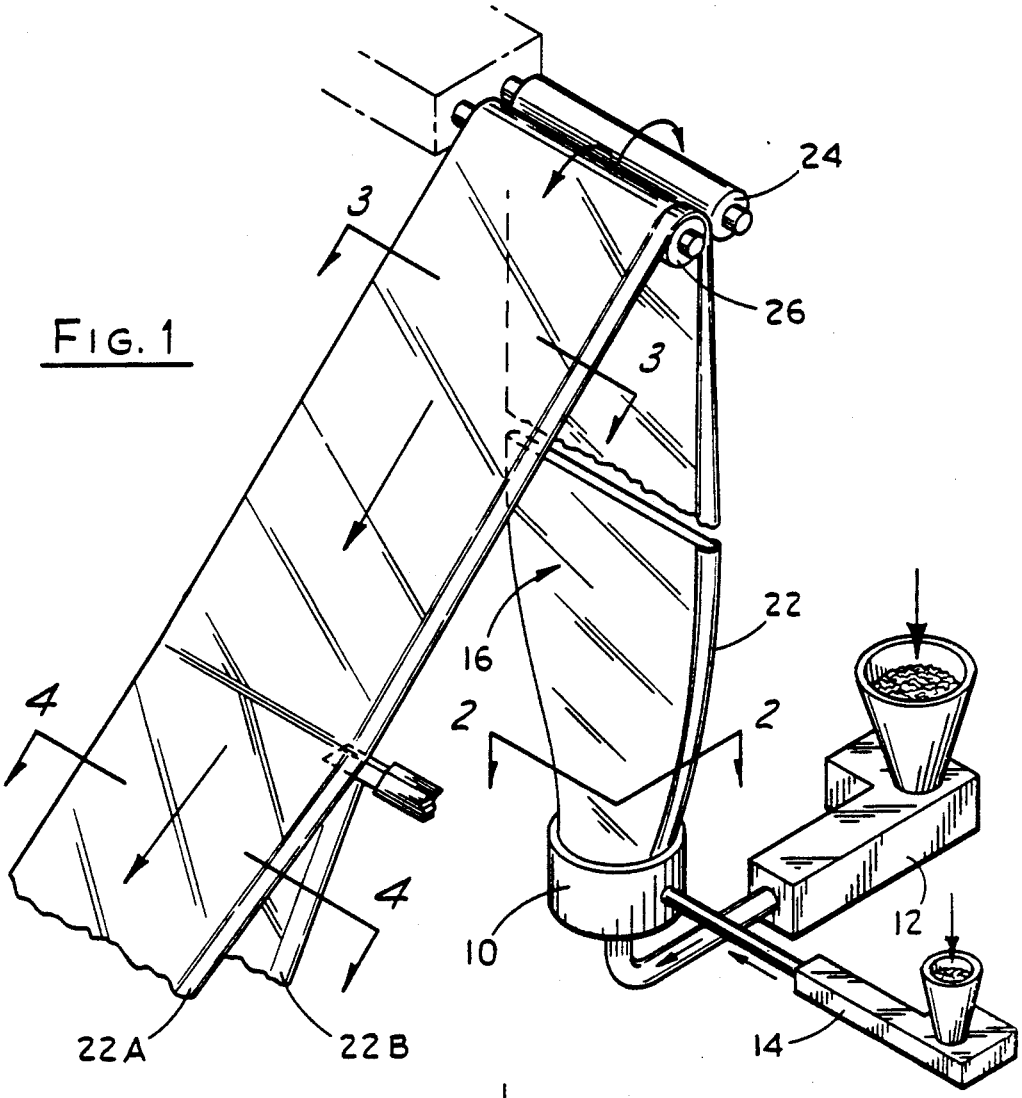
FIG. 1 is a perspective, schematic view of the film and its forming and slitting apparatus used to make draw tape bags of one embodiment of the invention.
Figure 2:
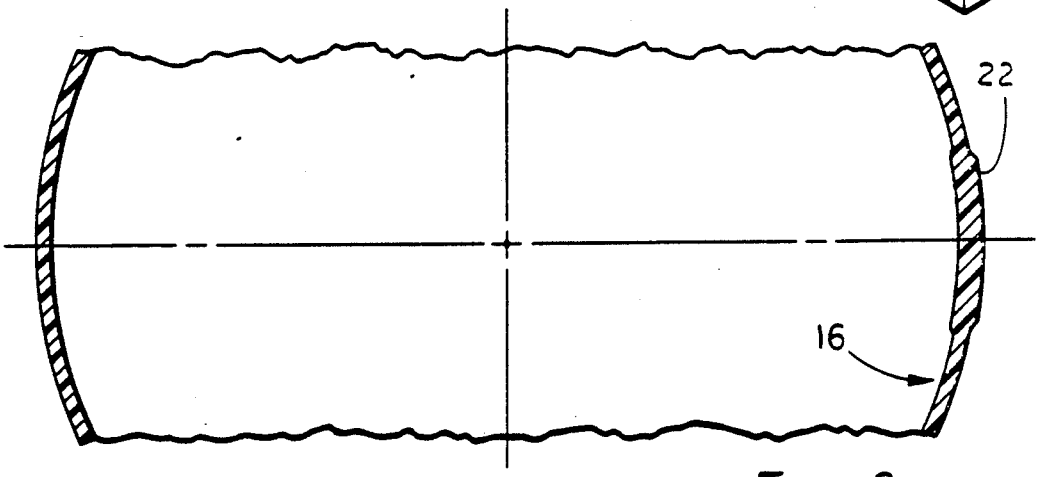
FIG. 2 is a fragmentary sectional view taken along line 2—2 of FIG. 1.

As shown in FIG. 1, in one embodiment the process for making draw tape bags of the present invention utilizes a blown film die 10 fed by two extruders 12 and 14. The first extruder 12 provides a first molten resin to the main section of the blown film die 10. The second extruder 14 supplies a second molten resin to a special port in the die 10. The blown film 16 formed from the die 10 thus comprises two different resins. In the preferred embodiment the second resin has a greater strength in film form than the film of the first resin. Also, the width between the die lips through which the second resin is extruded is wider than the lips for the rest of the die 10. As shown in FIG. 2, the tubular film 16 thus has a longitudinal region of greater strength 22 running parallel to the tube axis. In this embodiment, the region 22 is substantially thicker than the remainder of the film 16, which has a fairly uniform cross-section thickness.

Figure 3:
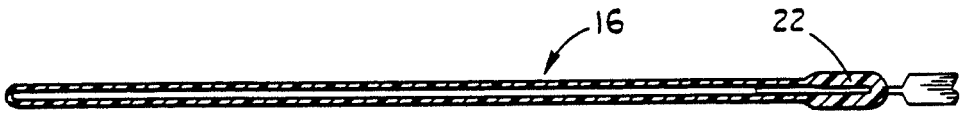
FIG. 3 is a sectional view taken along line 3—3 of FIG. 2.
Figure 4:
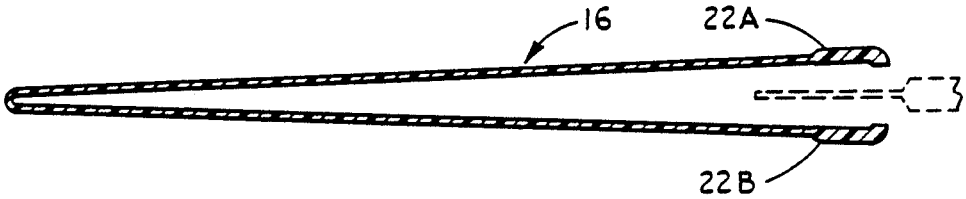
FIG. 4 is a sectional view taken along line 4—4 of FIG. 1.

The blown film tube is collapsed between a pair of rollers 24 and 26. One of the resulting folds in the tube film is formed as closely as possible to the center of the longitudinal region of greater strength 22 (see FIG. 3). In the preferred embodiment, the tube is next slit along the fold in region 22, as shown in FIGS. 3 and 4. Thus the region of greater strength 22 is slit into two halves 22A and 22B.

Figure 5:
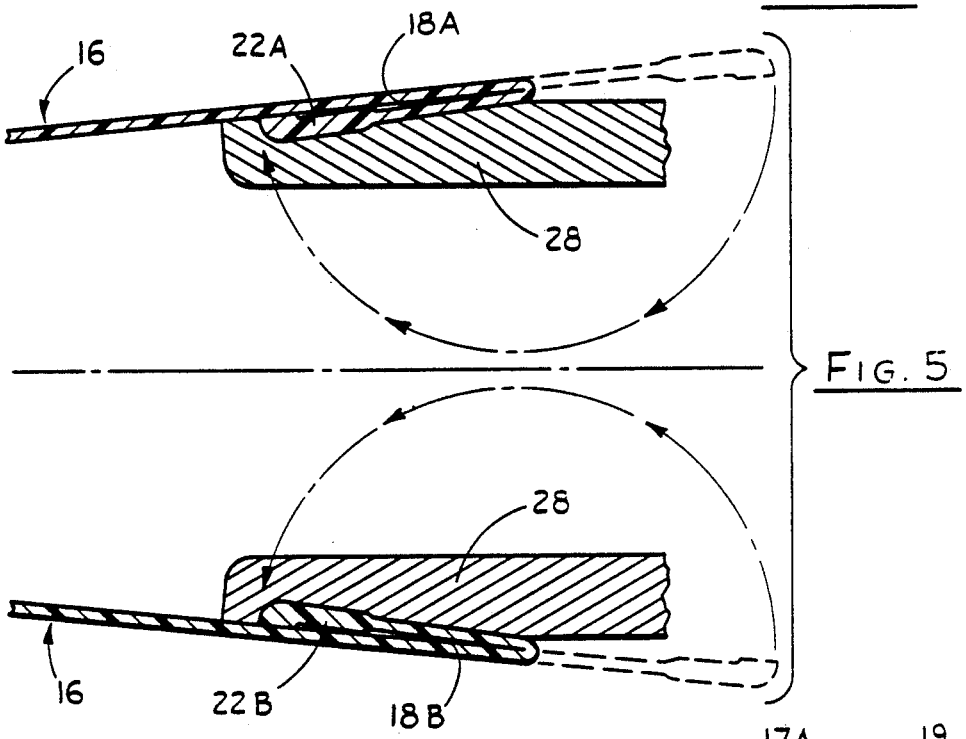
FIG. 5 is a fragmentary sectional view showing the beginning formation steps for the hem of the film shown in FIG. 4.
Figure 6:
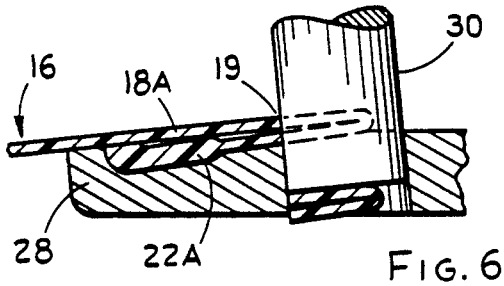
FIG. 6 is a fragmentary sectional view of the process of punching the draw string access holes in the film of FIG. 5.

A set of plows 28 are next used to turn the slit edges of film 16 inwardly to form pockets 18A and 18B (FIG. 5). After the pockets 18A and 18B are formed, a punch 30 is used to form a draw tape access hole 19 at bag width intervals through the folds of pockets 18A and 18B. (FIG. 6 shows this operation for pocket 18A. Not shown is an identical punch for pocket 18B.)

Figure 7:
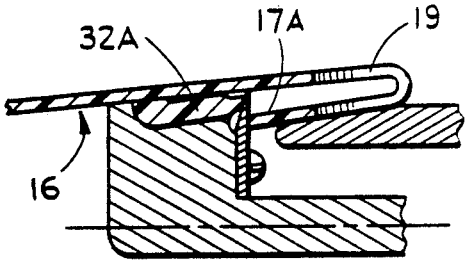
FIG. 7 is a fragmentary sectional view of the film resulting from the step shown in FIG. 6 showing the severing of the draw tape from the remainder of the bag.

Once the draw tape access holes 19 are formed, the draw tapes 32A (and 32B not shown) are formed by slitting the half regions 22A and 22B from off of the remainder of film 16, leaving film 16 as a continuous sheet with two side edges 17A (as shown in FIG. 7) and 17B (not shown). Of course the film forming process, while giving fairly uniform films, will not produce a film where the boundry between regions is as straight as can be cut by the equipment used to slit out the draw tapes. It is thus expected that some of the first resin will end up on the edge of the draw tapes 32 or some of the second resin will be on the edge of the remaining continuous sheet. However, the draw tapes 32 will comprise primarily the second resin and the continuous sheet will comprise primarily the first resin.

Figure 8:
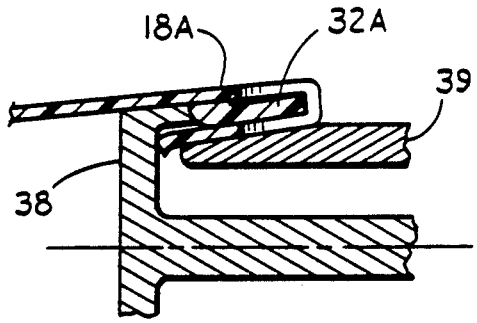
FIG. 8 is a fragmentary sectional view of the film of FIG. 7 showing the draw tape inserted into the hem.
Figure 9:
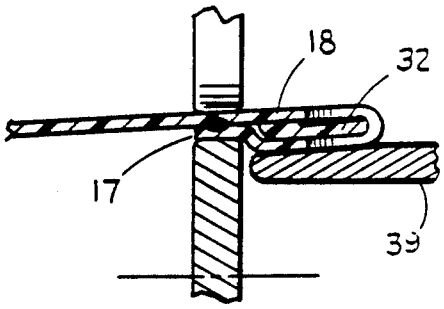
FIG. 9 is a fragmentary sectional view of the film of FIG. 8 showing the formation of the hem seal.

After the draw tapes are cut, another set of plows 38 and 39 are used to insert the draw tapes 32A and 32B into their respective pockets 18A and 18B (FIG. 8). The film edges 17 are then sealed to the film wall to seal the pockets 18, encasing the draw tapes 32 in the resulting hems. The draw tapes 32 are visible to and can be grasped by the user via the draw tape access holes 19.

Figure 10:
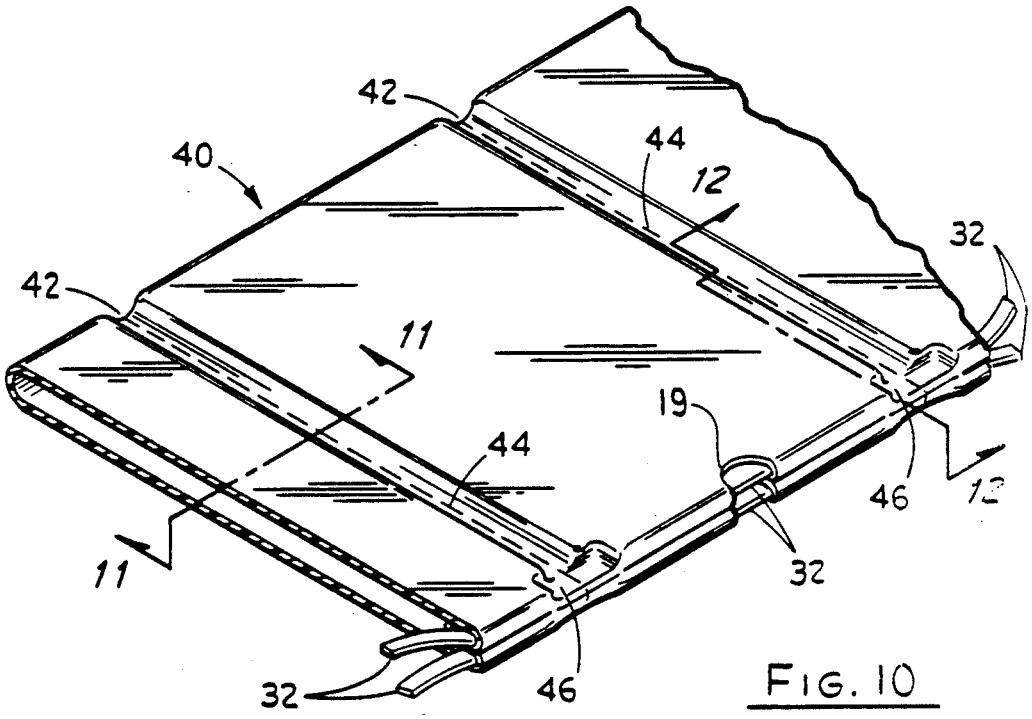
FIG. 10 is a perspective view of the film of FIG. 1 after the hem seals and bag side seams have been formed.
Figure 11:
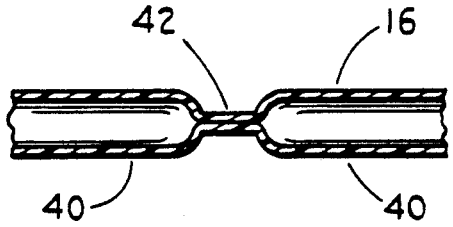
FIG. 11 is a fragmentary sectional view taken along line 11—11 of FIG. 10.
Figure 12:
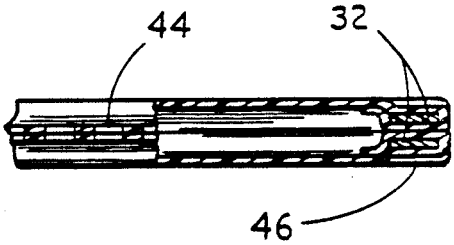
FIG. 12 is a fragmentary sectional view taken along line 12—12 of FIG. 10.

The step of actually forming bags 40 from the film 16 involves the formation of transverse seams 42 in the folded continuous sheet (see FIGS. 10 and 11). In the preferred embodiment, prior to forming seams 42, preseals 46 are made through the hems and draw tapes at the top of the bags 40 where the transverse seams 42 will extend. At the same time seams 42 are made, the individual bags may be severed from one another. In the preferred embodiment, a perforation 44 is made in the center of the transverse seam 42 (see FIGS. 10–12) and the bags 40 are not completely severed until the bags enter the packaging equipment.

In another embodiment, only one resin is used and the second extruder 14 may be omitted. In this embodiment, the greater strength of longitudinal region 22 is due solely to the increased thickness of the film 16 where it is extruded from the thick region of the die 10. In this embodiment, the preferred ratio of the thickness of the region 22 to the thickness of the rest of the film is between about 1.5:1 and 10:1. The thicker region will generally cover between about 1% and about 10% of the circumference of the film, depending of course on the bag size and the desired draw tape width.

In another embodiment, two resins are used, but the die 10 has a uniform opening around its circumference. The longitudinal region 22 is thus of greater strength primarily because of the difference in chemical composition of the second resin, rather than its thickness. However, due to different blow-up ratios for the two resins used, the film 16 may still have a different thickness in region 22, even though the die lip gap is uniform. For example, HDPE has a higher blow up ratio than LDPE. For HDPE, a 15 inch bubble is typically made using a 3 inch die, whereas for LDPE a 10 inch die is used for a 15 inch bubble.

In both of these additional embodiments, the subsequent draw tape, hem and bag making steps used in the preferred embodiment may be used.

It is also noted that the draw tape, hem and bag making steps are subject to variation. For example, the draw tape access holes 19 may be formed prior to the tube of film 16 being slit, or after it is slit and before pockets 18 are formed. Also, the pockets 18 may be aligned and one punch used to form holes 19 simultaneously through both pockets. Also, the draw tapes may be severed from the film 16 before the pockets 18 are formed, and the region 22 may be completely severed from the film 16 before it is slit, or it may be severed and slit simultaneously. Also, the hems may be formed on the outside of the bag, rather than on the inside.

In the preferred embodiment, the first resin, used to make the bag wall, is linear low density polyethylene ("LLDPE")and the second resin, used to form the draw tapes, is high density polyethylene ("HDPE"). Of course other resins may be used, such as LDPE or HDPE for the bag wall. Where the region 22 is of greater thickness, the second resin may be LDPE or LLDPE. The preferred thickness of the film of longitudinal region 22 is between about 0.3 mil. and about 4 mils. The preferred thickness of the remainder of the film 16 is between about 0.3 mil and about 3 mils.

The preferred method of forming the hem seals, preseals and bag side seams are heat welding, well known in the art. The temperature and dwell time for forming such heat welds will depend on the bag and draw tape material and thickness. The various heat seals are preferably formed while the film 16 is in continuous motion. Conventional heat sealing methods such as hot wheels, hot air or the like can be used. A sealing bar on a drum with a belt back up is preferred. The bags are preferably severed by a rotating knife on a drum. One preferred method of forming the hem seals is disclosed in U.S. Patent application Ser. No. 07/036,896, now entitled "Hem Seal For Draw Tape Bags" by the present inventor, incorporated herein by reference.

Depending on the resin used to make the film 16 and longitudinal region 22, the blown film forming process may require adjustment to provide slow quenching rates to get adequate annealing conditions.

In the embodiments where more than one resin is used, the resins could be colored differently so that the draw tapes would be different color than the bag wall material.

Follows is an example of one preferred embodiment of the invention.

EXAMPLE 1

A draw tape trash bag having finished dimensions of 30 inches wide, 34 inches deep and 1.5 mil bag wall thickness is formed as follows:

The main inlet of an 8 inch blown film die is connected to an extruder feeding LLDPE at a temperature of 380° F. and at a rate of 645 lbs/hr.

A second extruder feeds HDPE at a temperature of 420° F. and a rate of 37.5 lbs/hr. into a secondary inlet in the side of the die. The die lip gap is uniform at 0.050 inches. A tubular film is formed with a bubble diameter of 23 inches, cooled, and taken off the blown film equipment at a line speed of 250 feet per minute.

The circumference of the bubble is 72 inches of LLDPE of 1.5 mils thickness and 2 inches of HDPE of 3 mils thickness. The bubble is collapsed into a folded tube with one fold in the center of the HDPE area. The tube is slit at this fold point. Also, the HDPE marginal edges, each 1 inch wide, are slit from the remaining folded sheet. The remaining sheet edges are folded over to provide a 2 inch hem on each side of the film. Draw tape access holes are formed by punching 2 inch diameter semi-circle holes at the top 1 inch of the folded bag at 30 inch intervals.

The HDPE draw tapes are next plowed into the hems, and hems are sealed, encasing the draw tapes. Pre-seal welds, ½ inch wide and two inches long, are made across the hems at 30 inch intervals to seal together the draw tapes and the hem/bag walls, at points intermediate with the draw tape access holes. Bag side seams are formed by ¼ inch wide heat seals transverse to the film travel direction at 30 inch intervals in registration with the pre-seals. A perforation is made in the center of these heat seals. The connected bags move to a packaging line where they are folded, rolled and boxed.

The resulting bag will have a tensile strength of about 7.5 lbs for a one inch wide strip in the bag walls, yet the draw tapes, integrally formed with and severed from the marginal portions of the bag walls, will have a tensile strength of about 30 lbs for a one inch wide strip.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

I claim:

1. The process of forming draw tape bags comprising the steps of:

a) extruding a resin through a blow film die to form a tubular film having a blown cross section in which the film is substantially uniform over its entire circumference except in a region of greater tensile strength, where the cross section is substantially thicker, b) slitting said substantially thicker region out of said tubular film and into two draw tape ribbons, leaving a continuous sheet of film of substantially uniform thickness and having two edges, the two edges and the two draw tape ribbons being substantially the same length, c) forming draw tape access holes at bag width intervals adjacent the edges of said continuous sheet, d) forming each of the edges into a hem around one of said ribbons, and e) heat sealing and severing the folded film at transverse bag width intervals to form individual bags and to seal the draw tape ribbons to the bag walls at the resulting bag edges, the resulting bags having draw tapes of greater film thickness and tensile strength than the bag walls.

2. The process of claim 1 wherein the tube is first slit near the center of the region of greater tensile strength and the resulting edges are folded over to form pockets, the resulting halves of the regions of greater strength afterwards being slit off from their respective edges and plowed into their respective pockets, the pockets then being sealed to form hems encasing the draw tapes.

3. The process of claim 1 wherein the region of greater tensile strength is simultaneously slit out of the tube of film and slit into two ribbons, the remaining edges of the tube afterwards being folded over to form the hems.

4. The process of claim 1 wherein the draw tape access holes are formed in the material which will be used to form the hems prior to the tube being slit.

5. The process of claim 1 wherein the draw tape access holes are formed after the tube is slit but prior to its edges being folded to form the hems.

6. The process of claim 1 wherein the draw tape access holes are formed after the tube is slit and its edges are folded to form pockets but before the draw tapes are encased into hems formed from said pockets.

7. The process of claim 1 wherein the transverse seams are formed by first making a pre-seal heat weld in the region of the hems to secure the draw tapes in those regions to the bag wall material and then be heat sealing the entire width of the tube.

8. The process of claim 1 wherein the bag edges are formed by heat sealing the continuous sheet across its width and the step of severing the folded continuous sheet to form individual bags comprises perforating the region between the edges of adjacent bags, leaving adjacent bags connected by the film areas between the resulting perforations.

9. The process of claim 1 wherein the step of severing the folded continuous sheet to form individual bags precedes the step of forming transverse seams in the continuous sheet.

10. The process of claim 1 wherein the resin comprises linear low density polyethylene.

11. The process of claim 1 wherein the ratio of the thickness of the substantially thicker section of the blow tubular film to the thickness of the remainder of the film is between about 1.5:1 and about 10:1.

12. The process of claim 1 wherein the substantially thicker section of the blown tubular film comprises a width of between about 1% and about 10% of the circumference of the tubular film.

13. A process for forming draw tape bags comprising the steps of:

a) extruding a first and second thermoplastic resin of different composition through a blown film die to form a tubular film having a blow cross section in which the film is substantially uniform and comprises said first resin over its circumference except in a region of greater tensile strength where the film comprises said second resin, the thickness of the film in said second resin region at the die opening being at least as great as that of the remaining circumference of said first resin, b) slitting the region formed by said second resin out of said tubular film and into two draw tape ribbons, leaving a continuous sheet of film comprising primarily said first resin and having two edges, the two edges and the two draw tape ribbons being substantially the length.

c) forming draw tape access holes at bag width intervals adjacent the edges of said remaining sheet, d) forming each of the edges into a hem around one of said ribbons, and e) heat sealing and severing the folded film at transverse bag width intervals to form individual bags and to seal the draw tape ribbons to the bag walls at the edges of the bags, the resulting bags having draw tapes of greater tensile strength than that of the bag walls.

14. The process of claim 13 wherein said first resin comprises linear low density polyethylene and wherein said second resin comprises high density polyethylene.

15. The method of claim 13 wherein the blown circumference of the tubular film is about 74 inches and the width of the region formed by said second resin is about two inches.

16. The process of claim 13 wherein the tube is first slit near the center of the region of greater strength and the resulting edges are folded over to form pockets, the resulting halves of the regions of greater strength afterwards being slit off from their respective edges and plowed into their respective pockets, the pockets then being sealed to form hems encasing the draw tapes.

17. The process of claim 13 wherein the region of greater tensile strength is simultaneously slit out of the tube of film and slit into two ribbons, the remaining edges of the tube afterwards being folded over to form the hems.

18. The process of claim 12 wherein the draw tape access holes are formed in the material which will be used to form the hems prior to the tube being slit.

19. The process of claim 13 wherein the draw tape access holes are formed after the tube is slit but prior to its edges being folded to form the hems.

20. The process of claim 13 wherein the draw tape access holes are formed after the tube is slit and its edges are folded to form pockets but before the draw tapes are encased into hems formed from said pockets.

21. The process of claim 13 wherein the transverse seams are formed by first making a pre-seal heat weld in the region of the hems to secure the draw tapes in those regions to the bag wall material and then by heat sealing the entire width of the tube.

22. The process of claim 13 wherein the bag edges are formed by heat sealing the continuous sheet across its width and the step of severing the folded continuous sheet to form individual bags comprises perforating the region between the edges of adjacent bags, leaving adjacent bags connected by the film areas between the resulting perforations.

23. The process of claim 13 wherein the step of severing the folded continuous sheet to form individual bags precedes the step of forming transverse seams in the continuous sheet.

* * * * *